US009377750B2

(12) United States Patent
Takahashi

(10) Patent No.: US 9,377,750 B2
(45) Date of Patent: Jun. 28, 2016

(54) IMAGE FORMING APPARATUS WITH FIXATION UNIT

(71) Applicant: CANON KABUSHIKI KAISHA, Tokyo (JP)

(72) Inventor: Ryosuke Takahashi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/809,508

(22) Filed: Jul. 27, 2015

(65) Prior Publication Data

US 2016/0033929 A1 Feb. 4, 2016

(30) Foreign Application Priority Data

Aug. 1, 2014 (JP) ..... 2014-157910

(51) Int. Cl.
*G03G 21/00* (2006.01)
*G03G 21/16* (2006.01)

(52) U.S. Cl.
CPC ..... *G03G 21/1661* (2013.01); *G03G 21/1685* (2013.01); *G03G 2221/1639* (2013.01); *G03G 2221/1657* (2013.01)

(58) Field of Classification Search
CPC ..... G03G 21/1661; G03G 21/1685; G03G 21/1647; G03G 2221/1651; G03G 2221/1657; G03G 2221/1639
USPC ..... 399/107, 110, 111, 122
See application file for complete search history.

(56) References Cited

U.S. PATENT DOCUMENTS 5,999,771 A * 12/1999 Wakihara ..... G03G 15/751 399/117
6,035,159 A 3/2000 Azuma et al.
2003/0053823 A1* 3/2003 Cho ..... F16D 1/101 399/167
2010/0272470 A1* 10/2010 Tomatsu ..... G03G 21/1647 399/167
2013/0243476 A1* 9/2013 Sato ..... G03G 21/623 399/110

FOREIGN PATENT DOCUMENTS

JP H10-104905 A 4/1998
JP 11258966 A * 9/1999
JP 2001-42587 A 2/2001
JP 2002149037 A * 5/2002

* cited by examiner

*Primary Examiner* — Robert Beatty
(74) *Attorney, Agent, or Firm* — Fitzpatrick, Cella, Harper & Scinto

(57) ABSTRACT

An object of the present invention is to increase the accuracy of positions of a drive gear and a driven gear without an increase in size of an apparatus. In an image forming apparatus, a driven gear 108 is provided on a free end side of a roller shaft 106 rather than at a portion 106*a*, of the roller shaft 106, supported by a fixation unit 50. A main assembly of the apparatus 1 has a support member 103 that is movable between a support position where, with the fixation unit 50 attached to the main assembly of the apparatus 1, a free end-side end of the roller shaft 106 is supported and a non-support position where, with the fixation unit 50 removed from the main assembly of the apparatus 1, the free end-side end of the roller shaft 106 is not supported.

9 Claims, 12 Drawing Sheets

IMAGE FORMING APPARATUS WITH FIXATION UNIT

BACKGROUND OF THE INVENTION

1. Field of the Invention

The present invention relates to an image forming apparatus that forms an image on a recording medium using a recording technique such as an electrophotographic recording process.

2. Description of the Related Art

Replaceable units are mounted in an image forming apparatus such as a printer or a copier which forms an image on a recording medium using an electrophotographic recording process. The replaceable units are, for example, a cartridge in which a photoreceptor is housed and a fixing unit, and replacement of these units allows the photoreceptor and a roller such as a fixing roller to be replaced with new ones. The photoreceptor and the fixing roller in these units are driven by a motor provided in the main assembly of the image forming apparatus. In order to transmit the power of the motor to the roller, an image forming main assembly of the apparatus-side gear needs to engage with a unit-side gear. For apparatus design reasons, the unit-side gear is forced to have a cantilevered configuration. When a gear with a cantilevered configuration is driven, the shaft of the gear is likely to be deflected to cause a possible jumping phenomenon, leading to the risk of stoppage of the apparatus or an abnormal sound.

In association with this problem, a configuration is known in which, for example, to allow transmission of driving from the main assembly of the apparatus to the removable unit, the unit is provided with a shaft with a twisted polygonal columnar protrusion, whereas the main assembly of the apparatus includes a coupling shaft that engages with the twisted polygonal column to transmit driving (Japanese Patent Application Laid-open No. H10-104905).

However, the configuration disclosed in Japanese Patent Application Laid-open No. H10-104905 involves an increased size of the apparatus due to the use of the coupling member. Furthermore, in an image forming apparatus that enables duplex printing, for example, a reverse roller that reverses a conveying direction of a recording medium needs to rotate in a normal direction and in a reverse direction. However, the configuration disclosed in Japanese Patent Application Laid-open No. H10-104905 can deal only with rotation in one direction and is thus unsuitable for a drive member that needs to rotate in both directions.

SUMMARY OF THE INVENTION

With these problems in view, an object of the present invention is to improve the accuracy of meshing between a drive gear and a driven gear without an increase in size of the apparatus.

Another object of the present invention is to provide an image forming apparatus that forms an image on a recording medium, the image forming apparatus comprising:

an main assembly of the apparatus including a drive source and a first gear rotated by power of the drive source;

a unit capable of being attached to and detached from the main assembly of the apparatus and including a roller and a second gear that meshes with the first gear to transmit the power of the drive source to the roller;

wherein the main assembly of the apparatus includes a support member, and with the unit attached to the main assembly of the apparatus, the support member is movable between a first position where a shaft that holds the second gear is supported and a second position where the shaft is not supported.

Another object of the present invention is to provide an image forming apparatus that forms an image on a recording medium, the image forming apparatus comprising:

an main assembly of the apparatus including a drive source and a first gear rotated by power of the drive source;

a unit capable of being attached to and detached from the main assembly of the apparatus and including a roller and a second gear that meshes with the first gear to transmit the power of the drive source to the roller;

wherein the unit includes a support member, and with the unit attached to the main assembly of the apparatus, the support member is movable between a first position where a shaft that holds the second gear is supported by the main assembly of the apparatus and a second position where the shaft is not supported by the main assembly of the apparatus.

Further features of the present invention will become apparent from the following description of exemplary embodiments (with reference to the attached drawings).

DESCRIPTION OF THE EMBODIMENTS

Embodiments of the present invention will now be described in detail based on examples with reference to the drawings. The dimensions, materials, shapes and relative dispositions or the like of the components described in the embodiments may need to be appropriately changed depending on the configuration and various conditions of the apparatus to which the present invention is applied. In other words, the scope of the invention is not limited to the following embodiments.

[General Configuration of the Image forming Apparatus]

Figure 1:
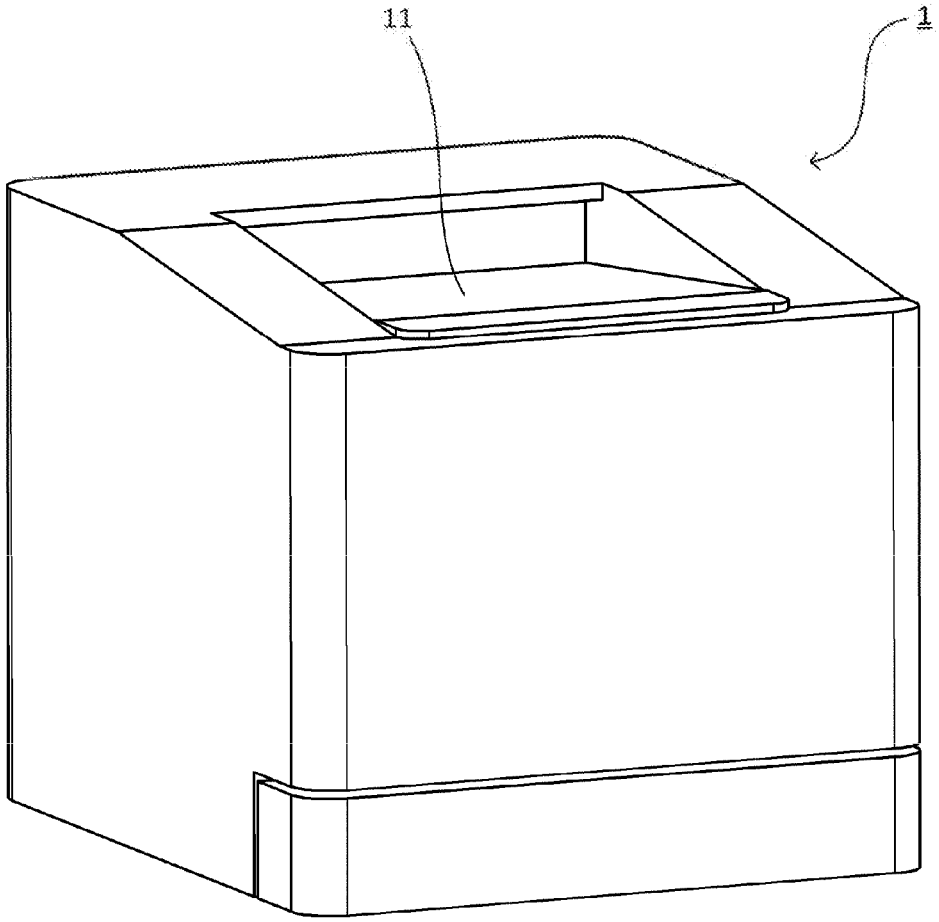
FIG. 1 is a perspective view of the appearance of an image forming apparatus according to the present embodiment.
Figure 2:
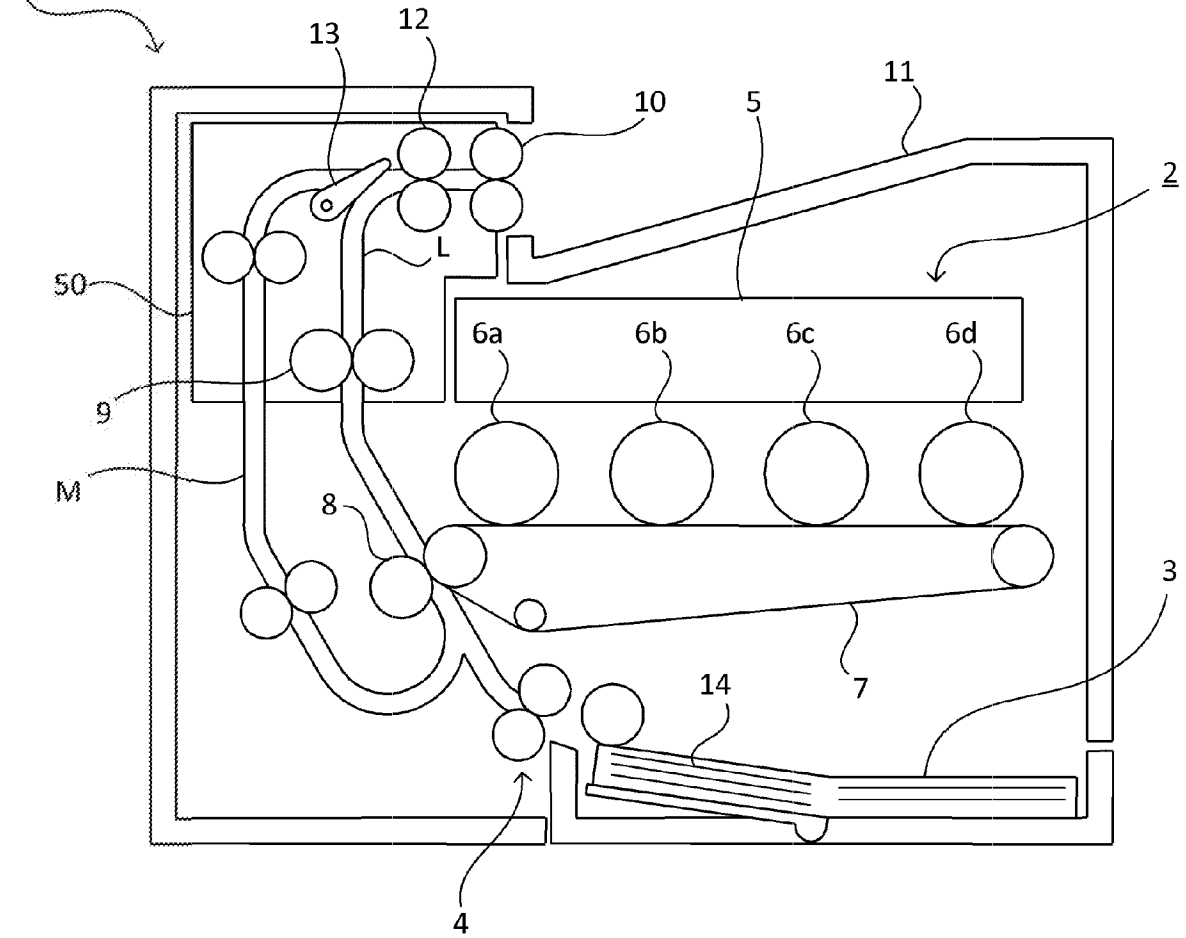
FIG. 2 is a schematic cross-sectional view of the image forming apparatus according to the present embodiment.

First, a general configuration of an image forming apparatus according to the present embodiment will be described with reference to FIG. 1 and FIG. 2. FIG. 1 is a perspective view of the appearance of the image forming apparatus according to the present embodiment. FIG. 2 is a schematic cross-sectional view of the image forming apparatus according to the present embodiment. The image forming apparatus according to the present embodiment is an image forming apparatus that enables both sides of a recording medium 14 to be printed.

The image forming apparatus according to the present embodiment includes an main assembly of the apparatus 1, an image forming section 2 inside the main assembly of the apparatus 1, a feed sheet housing section 3 provided underneath the image forming section 2 to house recording media 14 such as paper, and a sheet feeding apparatus 4 as depicted in FIG. 2.

The image forming section 2 is provided with a laser scanner 5, photosensitive drums 6*a*, 6*b*, 6*c*, and 6*d*, an endless belt 7, a transfer section 8 located opposite to and in contact with the endless belt 7, and a toner container and a developing roller neither of which is depicted in the drawings. Inside the main assembly of the apparatus 1, a fixing unit 9 that fixes a toner image as a developer image, a sheet discharging roller 10, and a discharged sheet stacking section 11 are provided downstream in the conveying direction of the recording medium 14.

The recording media 14 in the feed sheet housing section 3 are each fed to the image forming section 2 by the sheet feeding apparatus 4. A toner image formed by the image forming section 2 is transferred onto the recording medium 14 by the transfer section 8. Moreover, the toner image transferred to the recording medium 14 is fixed on the recording medium 14 by the fixing unit 9. The recording medium 14 with the toner image fixed thereon is discharged to the discharged sheet stacking section 11 by a discharging roller 10.

When duplex printing is performed, first, a sensor detects a trailing end of the recording medium 14. Then, at a predetermined timing after the trailing end of the recording medium 14 exits the fixing unit 9, a reverse roller (conveying roller) 12 in a fixation unit 50 rotates in a reverse direction via a driven gear (second gear) 108 (see FIGS. 3A, 3B, 4A and 4B) provided at an end of a roller shaft of the reverse roller 12. Consequently, the conveying direction of the recording medium 14 is switched to the reverse direction (a first conveying direction is switched to a second conveying direction that is opposite to the first conveying direction).

In a conveying path L, a movable conveying guide 13 that is movable in conjunction with reverse rotation of the reverse roller 12 is provided to convey the recording medium 14 conveyed in the opposite direction to a duplex conveying path M. Then, the recording medium 14 is fed to a transfer section 8, in which the toner image is transferred onto the recording medium 14. The toner image transferred onto the recording medium 14 is fixed on the recording medium 14 by the fixing unit 9 and then discharged to the discharged sheet stacking section 11 by the discharging roller 10.

In the present embodiment, the fixing unit 9, the sheet discharging roller 10, the reverse roller 12, and the movable conveying guide 13 are configured in the fixation unit (unit) 50, which can be attached to and detached from the main assembly of the apparatus 1.

Embodiment 1

[Driving Coupling Configuration of the Main Assembly of the Apparatus and the Fixing Unit]

Figure 3A:
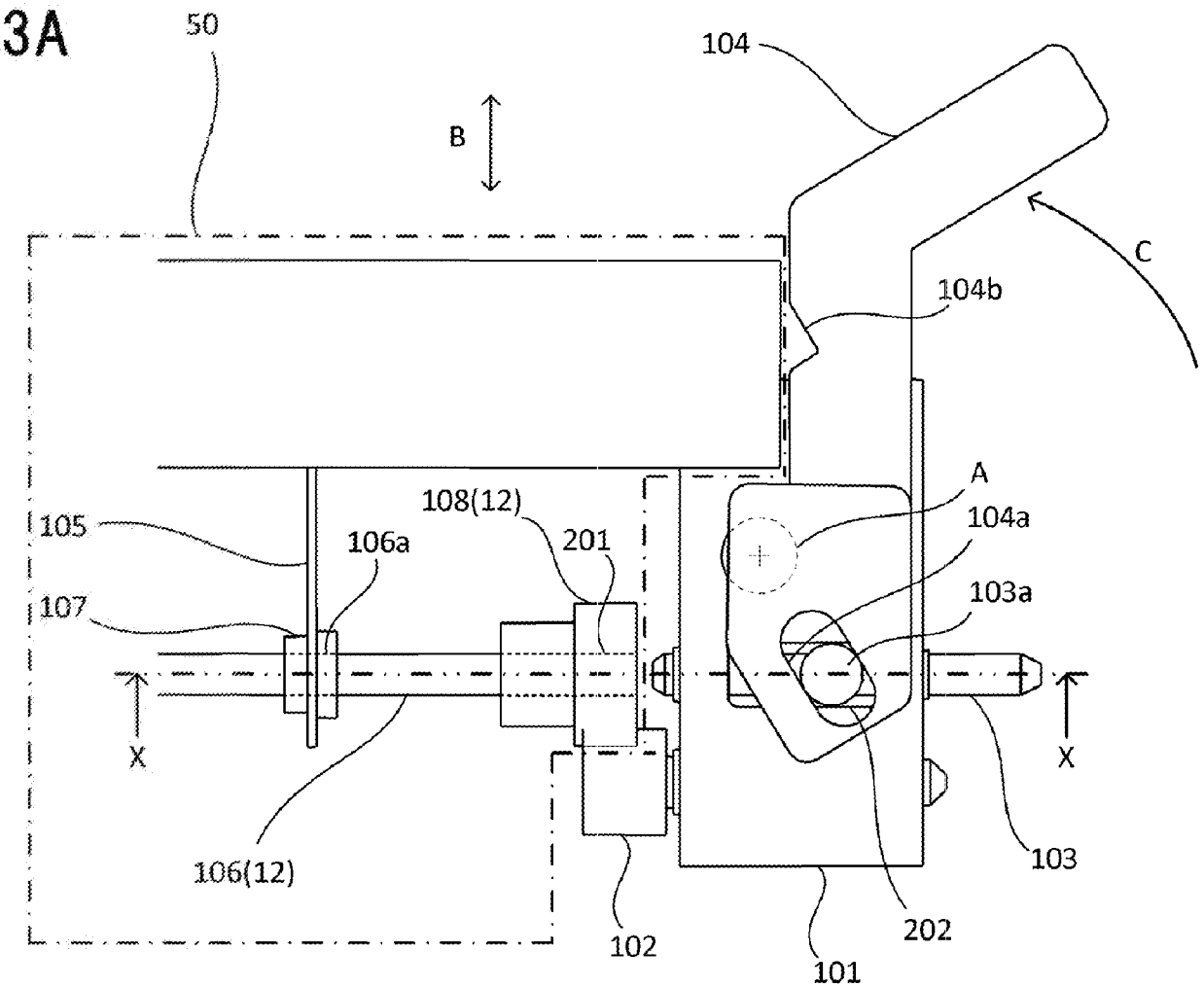
FIG. 3A and 3B are diagrams illustrating operations of a support member in Embodiment 1.
Figure 3B:
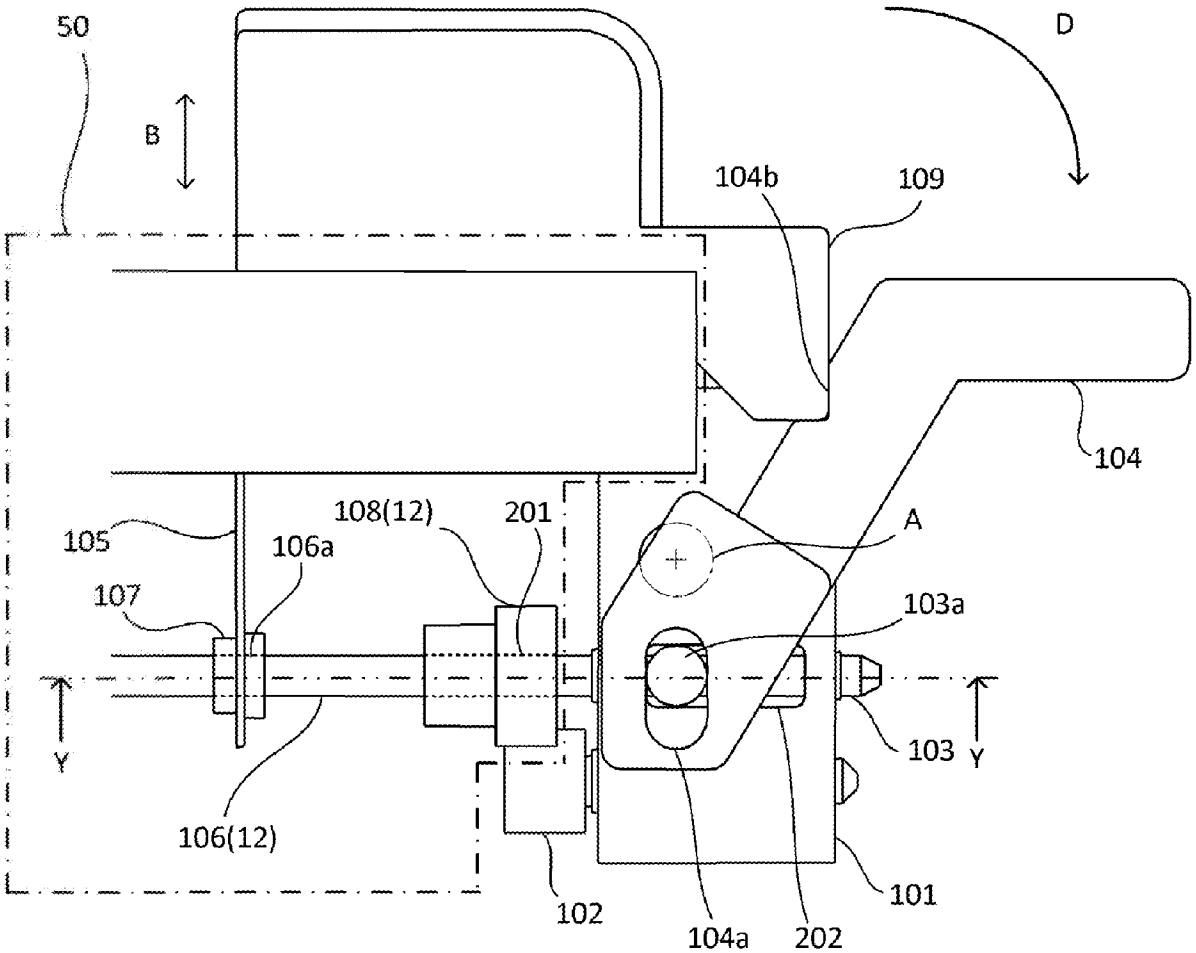
Figure 4A:
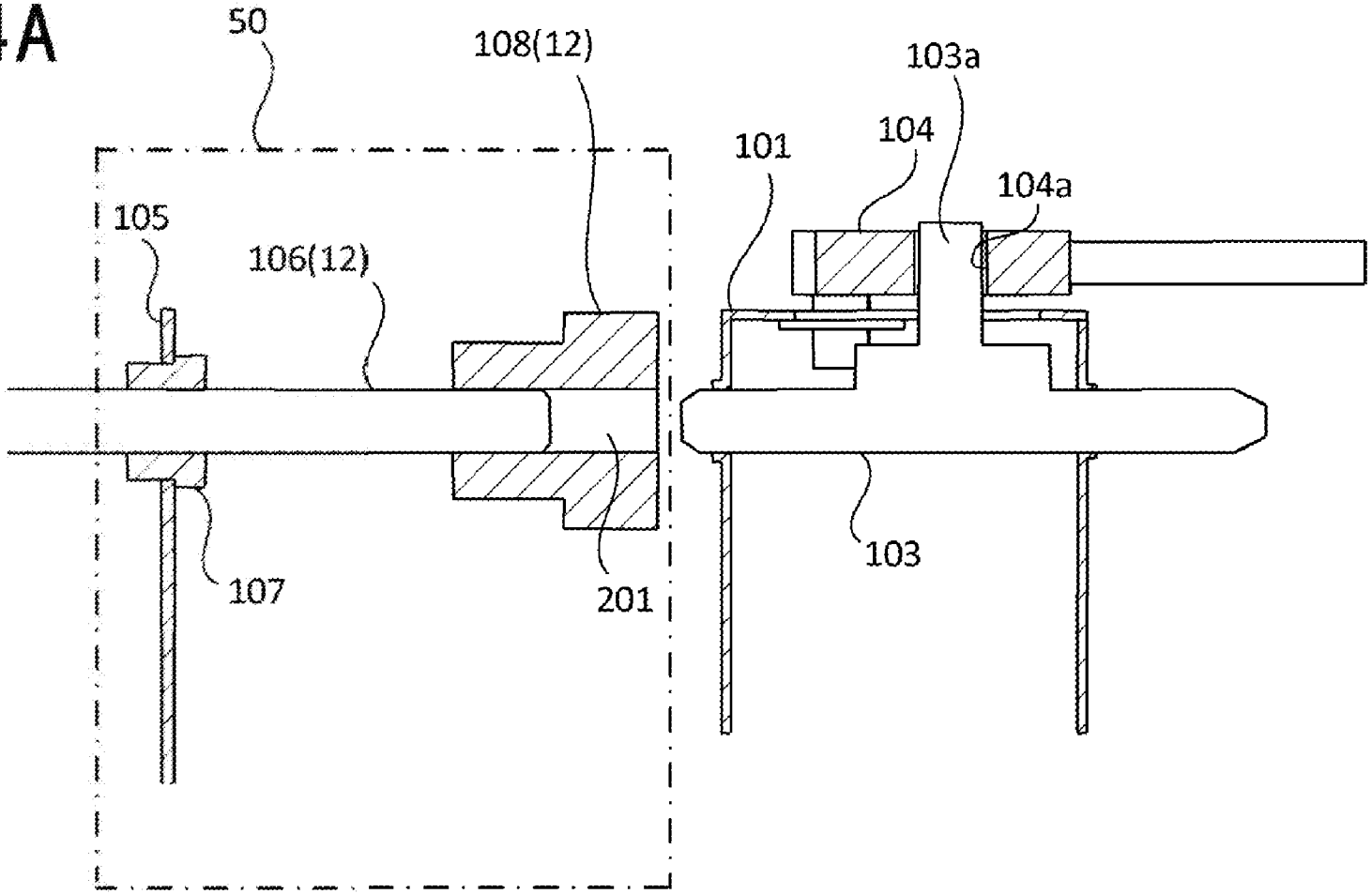
FIG. 4A and 4B are diagrams illustrating operations of the support member in Embodiment 1.
Figure 4B:
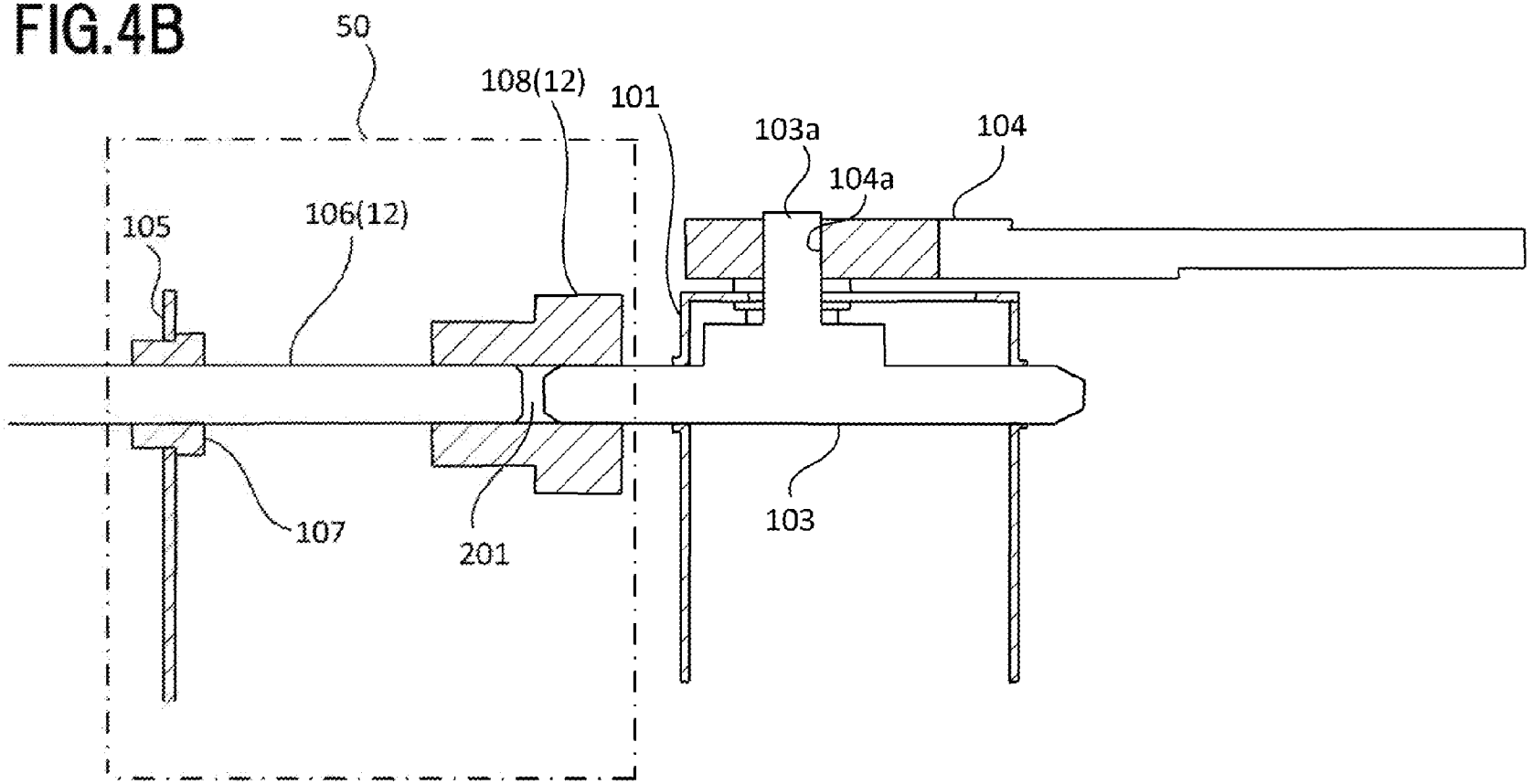

With reference to FIGS. 3A, 3B, 4A and 4B, a driving coupling configuration of the main assembly of the apparatus 1 and the fixation unit 50 in Embodiment 1 will be described. In the description, the reverse roller 12 provided in the fixation unit 50 and serving as a driven roller is taken as an example. FIGS. 3A, 3B, 4A and 4B are diagrams illustrating operations of a support member in Embodiment 1. FIG. 3A depicts a state where the support member is in a non-support position (second position). FIG. 3B depicts a state where the support member is in a support position (first position). FIG. 4A is a cross-sectional view taken along line X-X in FIG. 3A, and FIG. 4B is a cross-sectional view taken along line Y-Y in FIG. 3B.

The non-support position is a position of a support member 103 where the support member 103 is disengaged from an engagement hole 201 in the driven gear (second gear) 108 to allow the fixation unit 50 to be removed from the main assembly of the apparatus 1. On the other hand, the support position is a position of the support member 103 where printing is enabled and where the support member 103 is engaged with the engagement hole 201 in the driven gear 108, with the fixation unit 50 attached to the main assembly of the apparatus 1.

As depicted in FIGS. 3A and 3B, a housing section 101 of the main assembly of the apparatus 1 is provided with a drive gear (first gear) 102 rotated by a drive force from a drive source not depicted in the drawings.

As depicted in FIGS. 3A and 3B, the reverse roller 12 serving as a driven roller has a roller shaft 106 and the driven gear 108 provided so as to be rotatable coaxially with the roller shaft 106 and meshing with a drive gear 102 in an main assembly of the apparatus 1. The roller shaft 106 is cantilevered via a bearing 107 by a fixation unit side plate 105 of the fixation unit 50. The driven gear 108 is provided at a free end-side end of the roller shaft 106 rather than at a portion 106*a*, of the roller shaft 106, supported by the bearing 107. The driven gear 108 and the roller shaft 106 are locked with a pin or the like so as not to rotatable. The roller shaft 106 rotates in conjunction with rotation of the driven gear 108.

As depicted in FIGS. 4A and 4B, the support member 103 is supported by the housing section 101 of the main assembly of the apparatus 1 at opposite ends of the support member 103. As depicted in FIGS. 3A, 3B, 4A and 4B, the support member 103 is supported such that the support member 103 can be moved only in an axial direction of the roller shaft 106 by guiding a boss portion 103*a* provided on the support member 103 through a guide hole 202 formed in the housing section 101.

A lever member 104 provided in the main assembly of the apparatus 1 is provided so as to be rotatable around a point A depicted in FIG. 3A. The boss portion 103*a* provided on the support member 103 is coupled to the lever member 104 via a slot 104*a* formed in the lever member 104 such that the support member 103 can be moved by operating the lever member 104. In conjunction with movement of the lever member 104, the support member 103 moves straight in the same direction as the axial direction. The support member 103 is movable between the support position (first position) depicted in FIG. 3B and FIG. 4B where the support member 103 is engaged with the engagement hole 201 on the center of rotation of the driven gear 108 to support the end of the roller shaft 106 and the non-support position (second position) depicted in FIG. 3A and FIG. 4A where the support member 103 do not support the end of the roller shaft 106. In the present embodiment, support of the end of the roller shaft 106 by the support member 103 is not the direct support of the roller shaft 106 by the support member 103 but the support of the roller shaft 106 via the driven gear 108.

[Method for Attachment and Detachment of the Fixation Unit]

Arrow B depicted in FIGS. 3A and 3B is indicative of directions in which the fixation unit 50 is attached and detached. When the fixation unit 50 is mounted in the main assembly of the apparatus 1, the lever member 104 is operated in the direction of arrow C as depicted in FIG. 3A to establish a state in FIG. 3A to retract the support member 103 from an attachment and detachment trajectory of the fixation unit 50. The position of the support member 103 at this time is the non-support position.

After the fixation unit 50 is attached to the main assembly of the apparatus, the lever member 104 is operated in the direction of arrow D to move and engage the support member 103 with the engagement hole 201 in the driven gear 108 to support the end of the roller shaft 106 via the driven gear 108 as depicted in FIG. 3B. Then, the lock member 109 is attached to the fixation unit 50. The lock member 109 serves as a stopper to prevent rotation of the lever member 104. This ensures that the support member 103 reliably engages with the engagement hole 201 in the driven gear 108. The lever member 104 has a position regulating section 104*b* that is a groove into which the lock member 109 is fitted. With the lock member 109 fitted in the position regulating section 104*b*, the position of the lever member 104 is regulated.

When the fixation unit 50 is removed from the main assembly of the apparatus 1, first, the lock member 109 is removed. Then, the lever member 104 is rotationally operated in the direction of arrow C depicted in FIG. 3A to disengage the support member 103 from the engagement hole 201 in the driven gear 108, thus retracting the support member 103 from the removal trajectory (attachment and detachment trajectory) of the fixation unit 50. Moreover, screws and the like used to fix the main assembly of the apparatus 1 and the fixation unit 50 are removed to allow the fixation unit 50 to be removed from the main assembly of the apparatus 1.

In Embodiment 1, with the fixation unit 50 attached to the main assembly of the apparatus 1, the end of the roller shaft 106 cantilevered by the detachable fixation unit 50 is supported by the support member 103, as described above. Such a configuration enables an increase in the accuracy of meshing between the drive gear 102 of the main assembly of the apparatus 1 and the driven gear 108 of the fixation unit 50 without an increase in size of the apparatus. This allows suppression of the risk of stoppage of the apparatus or an abnormal sound, which is caused by a possible jumping phenomenon. Furthermore, for an image forming apparatus that enables duplex printing, a configuration can be provided which facilitates attachment and detachment of the fixation unit 50 with the reverse roller 12 that reverses the conveying direction of the recording medium 14 and that can rotate in the normal direction and in the reverse direction.

[Variation of the Driving Coupling Configuration for the Main Assembly of the Apparatus and the Fixation Unit]

Figure 5A:
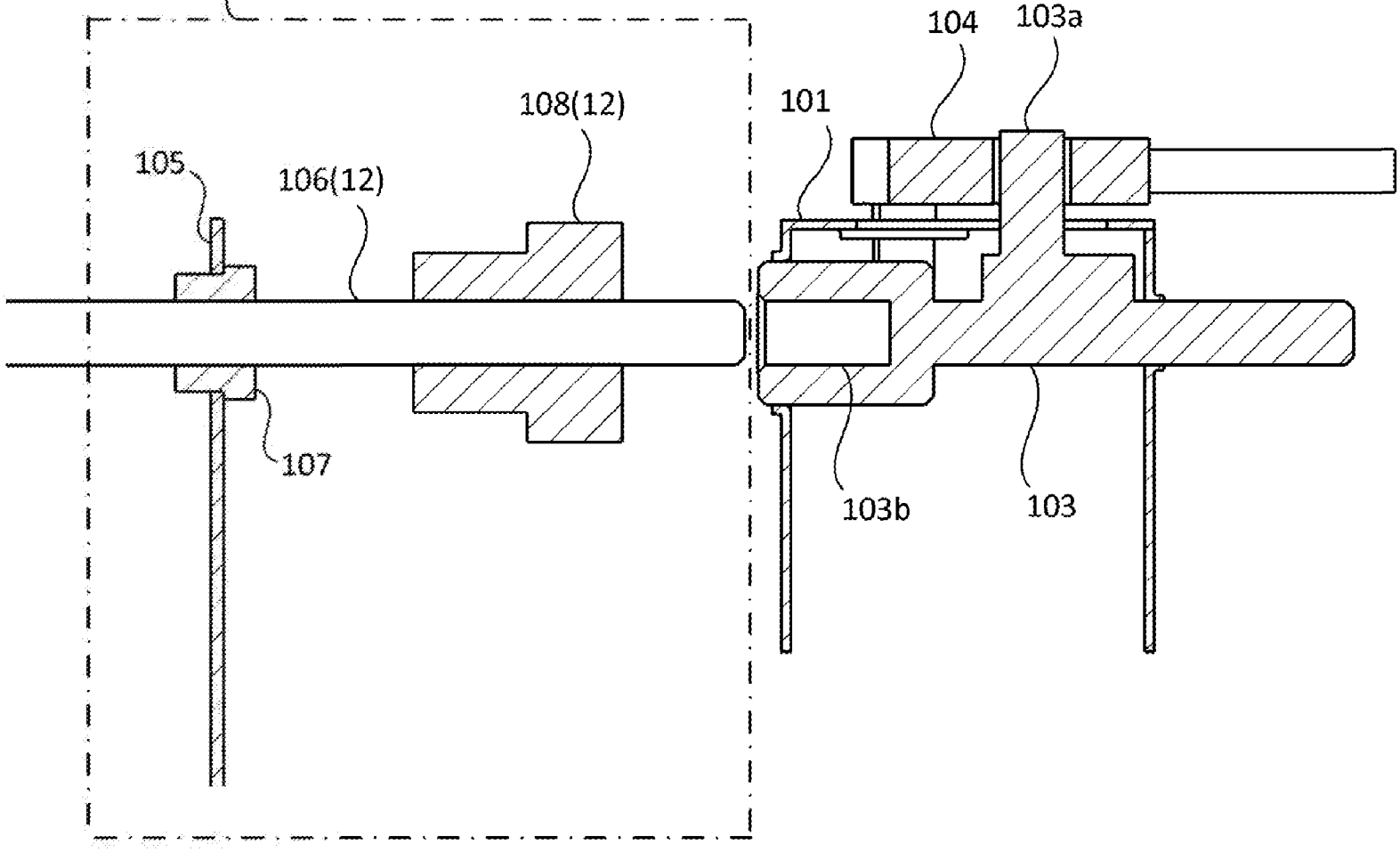
FIG. 5A and 5B are diagrams illustrating operations of the support member in a variation of Embodiment 1.
Figure 5B:
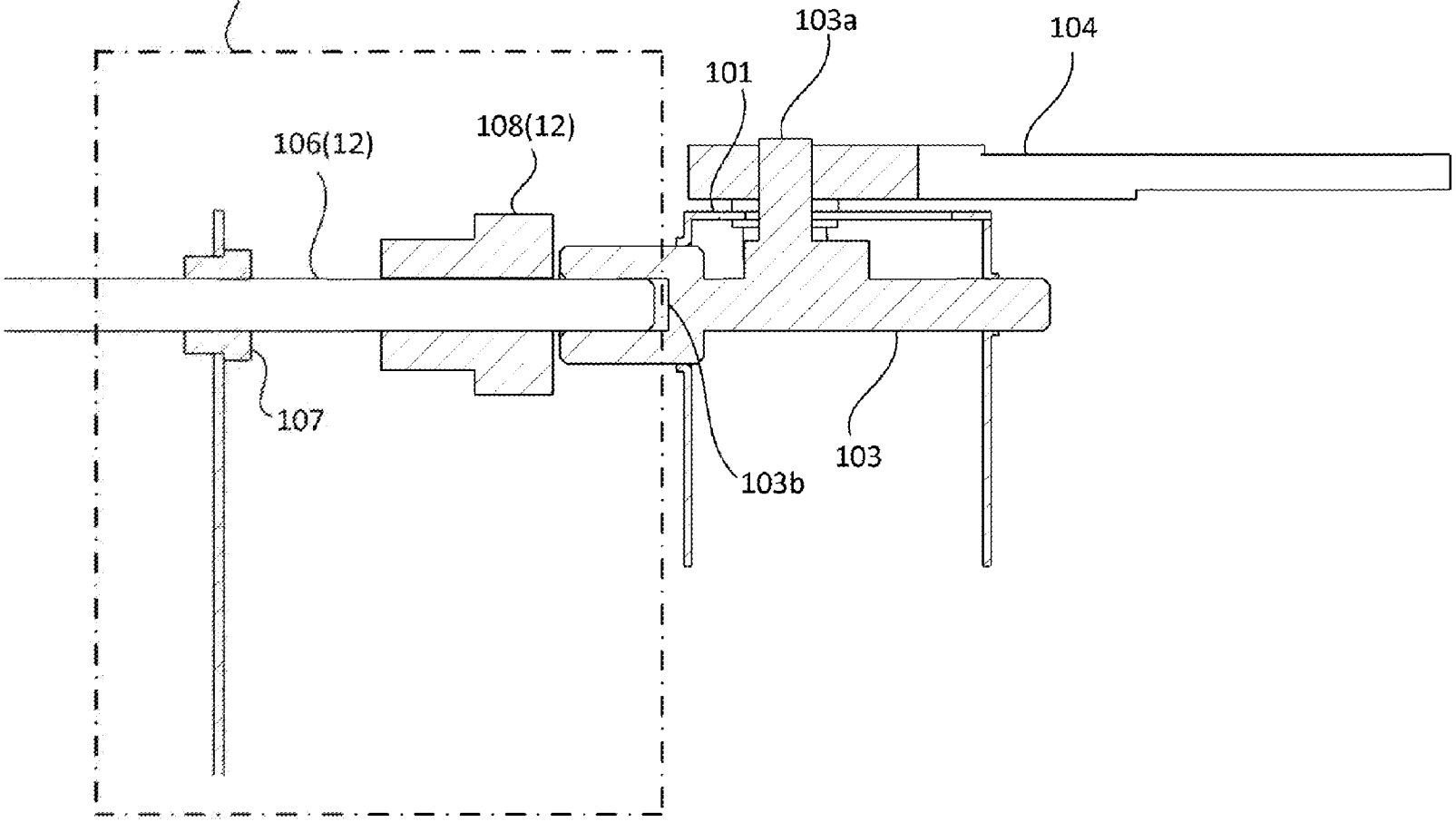

Now, a variation of Embodiment 1 will be described with reference to FIGS. 5A and 5B. FIGS. 5A and 5B are diagrams illustrating operations of a support member in the variation of the embodiment. FIG. 5A depicts a state where the support member is in the non-support position (second position). FIG. 5B depicts a state where the support member is in the support position (first position).

In Embodiment 1 described with reference to FIGS. 3A, 3B, 4A and 4B, the configuration has been described in which, in the support position, the support member 103 is engaged with the engagement hole 201 in the driven gear 108 to support the end of the roller shaft 106 via the driven gear 108. On the other hand, in the variation, a configuration will be described in which the support member 103 has a bearing portion 103*b* serving as an engagement hole such that, in the support position, the end of the roller shaft 106 is supported by engaging with the bearing portion 103*b*. The remaining part of the configuration is similar to the corresponding part of Embodiment 1 described using FIGS. 1 to 4. Thus, the same components are denoted by the same reference numerals and will thus not be described below.

FIG. 5A depicts a state where the bearing portion 103*b* is disengaged from the end of the roller shaft 106. FIG. 5B depicts a state where the bearing portion 103*b* is engaged with the end of the roller shaft 106, with the support member 103 supporting the end of the roller shaft 106. The support member 103 is movable between the non-support position depicted in FIG. 5A where the bearing portion 103*b* is disengaged from the end of the roller shaft 106 and the support position depicted in FIG. 5B where the bearing portion 103*b* is engaged with the end of the roller shaft 106 to support the end of the roller shaft 106.

Embodiment 2

Figure 6A:
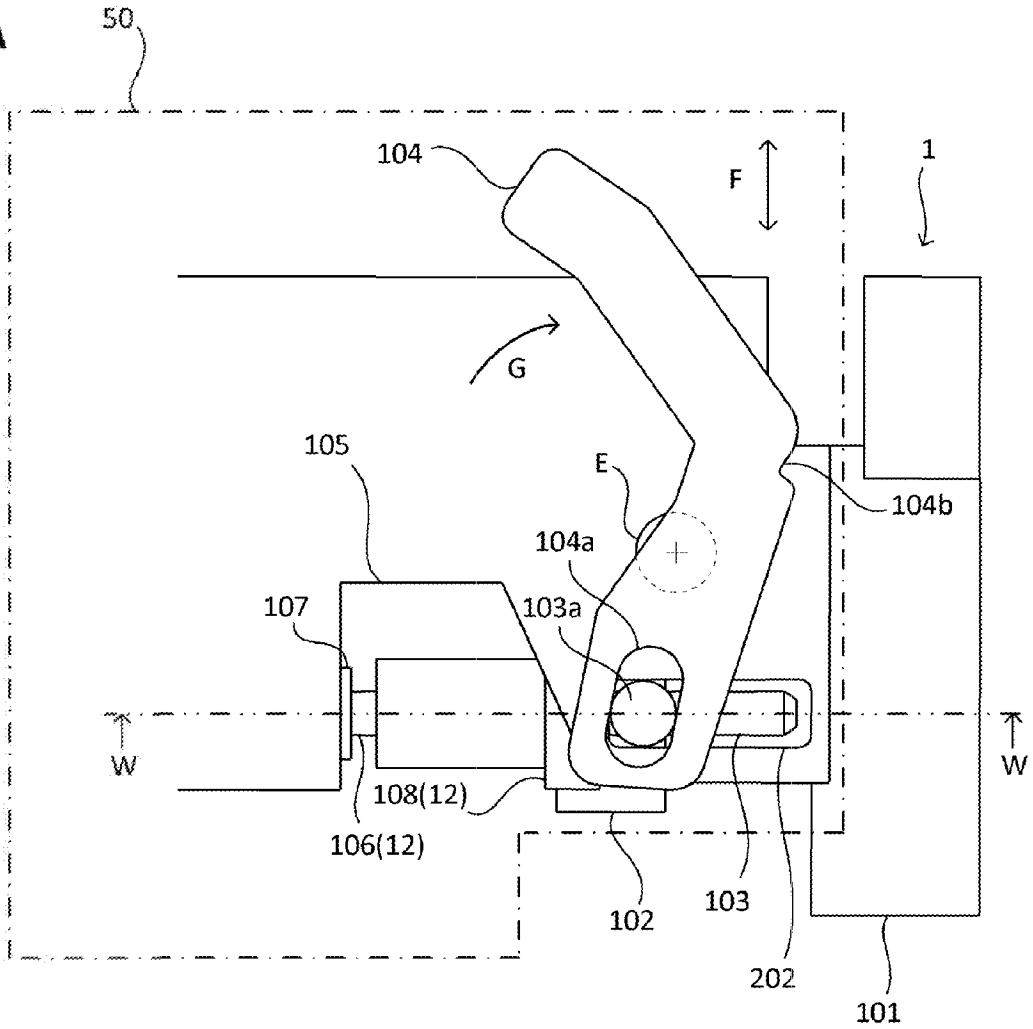
FIG. 6A and 6B are diagrams illustrating operations of a support member in Embodiment 2.
Figure 6B:
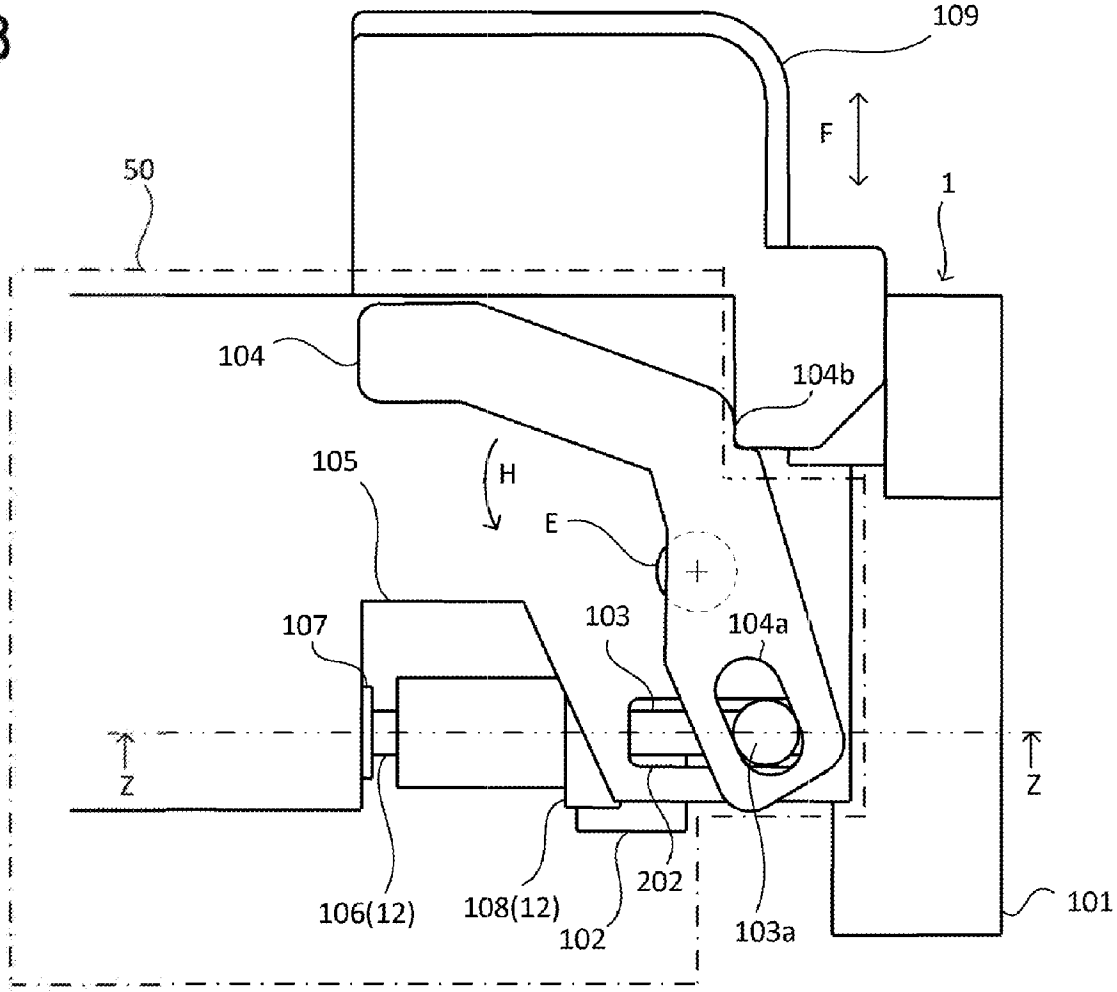
Figure 7A:
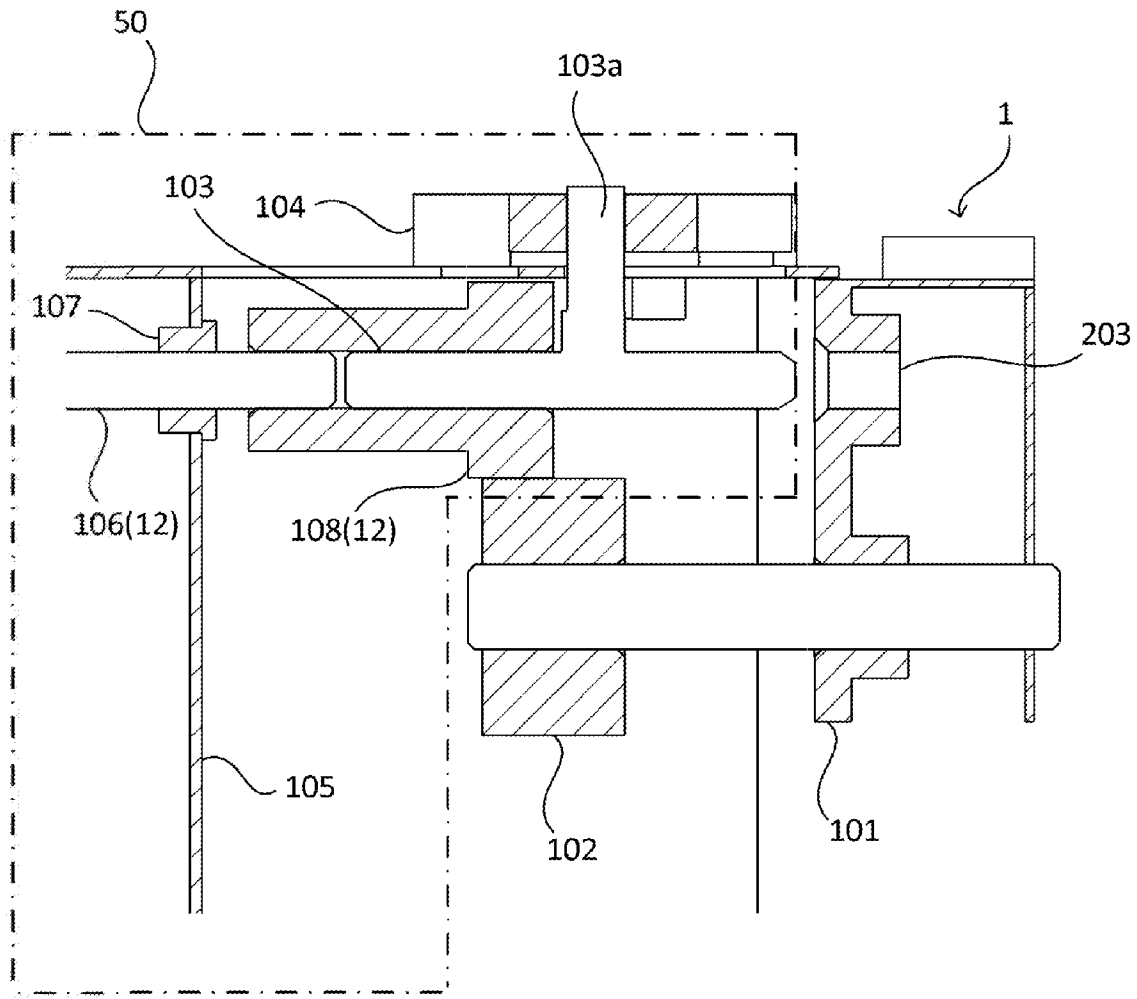
FIG. 7A and 7B are diagrams illustrating operations of the support member in Embodiment 2.
Figure 7B:
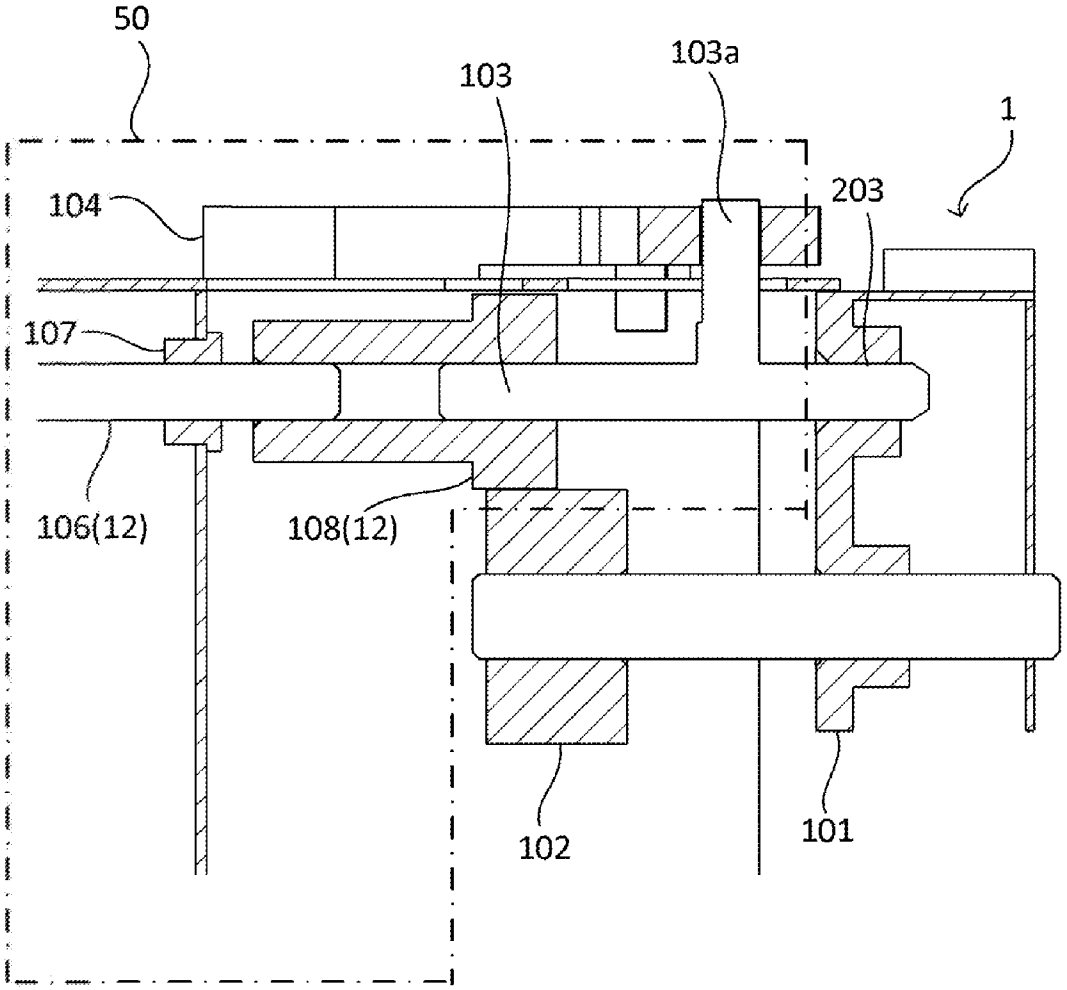

Now, with reference to FIGS. 6A, 6B, 7A and 7B, Embodiment 2 will be described. FIGS. 6A and 6B are diagrams illustrating operations of a support member in Embodiment 2. FIG. 6A depicts a state where the support member is in the non-support position (second position). FIG. 6B depicts a state where the support member is in the support position (first position). FIG. 7A is a cross-sectional view taken along line W-W in FIG. 6A, and FIG. 7B is a cross-sectional view taken along line Z-Z in FIG. 6B. A general configuration of the image forming apparatus is similar to the general configuration described in Embodiment 1. Thus, the same components are denoted by the same reference numerals and will thus not be described below. Embodiment 2 is different from Embodiment 1 in that the support member 103 and the lever member 104 are provided in the fixation unit 50, and produces the same effects as those of Embodiment 1.

[Driving Coupling Configuration for the Main Assembly of the Apparatus and the Fixation Unit]

As depicted in FIGS. 6A and 6B, in the fixation unit 50, the driven gear 108 is provided over the end of the roller shaft 106 of the reverse roller 12. One end side of the support member 103 is engaged with the engagement hole 201 on the center of rotation of the driven gear 108. On the other hand, the other end side of the support member 103 can be moved by movement of the support member 103 in the axial direction, between the support position (first position) where the other end is engaged with an engagement hole 203 in the housing section 101 of the main assembly of the apparatus 1 and supported by the main assembly of the apparatus 1 and the non-support position (second position) where the other end does not engage with the engagement hole 203 and is thus not supported by the main assembly of the apparatus 1. With the support member 103 in the non-support position, a mechanism provided by the roller shaft 106, the driven gear 108, and the support member 103 is generally cantilevered. With the support member 103 in the support position, the mechanism provided by the roller shaft 106, the driven gear 108, and the support member 103 is generally supported at both ends of the mechanism.

As depicted in FIGS. 6A, 6B, 7A and 7B, the driven gear 108 is provided over the end of the roller shaft 106 of the reverse roller 12. When the fixation unit 50 is attached to the main assembly of the apparatus 1, a drive force is transmitted from the drive gear 102 provided in the housing section 101 of the main assembly of the apparatus 1 to the driven gear 108. The drive gear 102 is supported by the housing section 101 of the main assembly of the apparatus 1 provided in the main assembly of the apparatus 1 and is driven by a drive source in the main assembly of the apparatus 1.

The support member 103 can be moved only in the axial direction of the roller shaft 106 by guiding the boss portion 103*a* provided on the support member 103 through a guide hole 202 formed in the fixation unit side plate 105, while supporting the driven gear 108. The lever member 104 can be rotated around a point E depicted in FIG. 6A. The boss portion 103*a* provided on the support member 103 is coupled to the lever member 104 via the slot 104*a* formed in the lever member 104 such that the support member 103 can be moved straight by operating the lever member 104.

[Method for Attachment and Detachment of the Fixation Unit]

Arrow F depicted in FIGS. 6A and 6B is indicative of directions in which the fixation unit 50 is attached and detached. When the fixation unit 50 is mounted in the main assembly of the apparatus 1, the lever member 104 is operated in the direction of arrow G as depicted in FIG. 6A to establish a state in FIG. 6A to retract the support member 103 from an attachment trajectory (attachment and detachment trajectory) of the fixation unit 50. Then, after the fixation unit 50 is attached to the main assembly of the apparatus 1, the lever member 104 is operated in the direction of arrow H to move and engage the support member 103 with the engagement hole 203 in the housing section 101 to support the whole of the mechanism provided by the roller shaft 106, the driven gear 108, and the support member 103, at both ends of the mechanism, as depicted in FIG. 6B.

Then, the lock member 109 is attached to the fixation unit 50. The lock member 109 serves as a stopper to prevent rotation of the lever member 104. This ensures that the support member 103 reliably engages with the engagement hole 203 in the housing section 101 of the main assembly of the apparatus 1. The lever member 104 has the position regulating section 104*b* that is a groove into which the lock member 109 is fitted. With the lock member 109 fitted in the position regulating section 104*b*, the position of the lever member 104 is regulated. When the fixation unit 50 is removed from the main assembly of the apparatus 1, first, the lock member 109 is removed. Then, the lever member 104 is rotationally operated in the direction of arrow G depicted in FIG. 6A to disengage the support member 103 from the engagement hole 203, thus retracting the support member 103 from the removal trajectory of the fixation unit 50. Then, screws and the like used to fix the main assembly of the apparatus 1 and the fixation unit 50 are removed to allow the fixation unit 50 to be removed from the main assembly of the apparatus 1.

As described above, in Embodiment 2, the end of the support member 103 included in the mechanism provided by the roller shaft 106, the driven gear 108, and the support member 103 and which is cantilevered is supported by the main assembly of the apparatus 1 to which the fixation unit 50 is attached. Such a configuration enables an increase in the accuracy of meshing between the drive gear 102 of the main assembly of the apparatus 1 and the driven gear 108 of the fixation unit 50, allowing suppression of the risk of stoppage of the apparatus or an abnormal sound, which is caused by a possible jumping phenomenon. Furthermore, for an image forming apparatus that enables duplex printing, a configuration can be provided which facilitates attachment and detachment of the fixation unit 50 with the reverse roller 12 that reverses the conveying direction of the recording medium 14.

In Embodiments 1 and 2 described above, the unit that can be attached to and detached from the main assembly of the apparatus 1 is the fixation unit. However, another unit such as a cartridge holding a photoreceptor may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-157910, filed Aug. 1, 2014, which is hereby incorporated by reference herein in its entirety.

What is claimed is:

1. An image forming apparatus that forms an image on a recording medium, the image forming apparatus comprising:

a main assembly of the apparatus including a drive source and a first gear rotated by power of the drive source; and a fixation unit configured to fix the image formed on the recording medium to the recording medium, the fixation unit capable of being attached to and detached from the main assembly of the apparatus and including a roller and a second gear that meshes with the first gear to transmit the power of the drive source to the roller, wherein the main assembly of the apparatus includes a support member, and with the fixation unit attached to the main assembly of the apparatus, the support member is movable between a first position where a shaft that holds the second gear is supported by the support member and a second position where the shaft is not supported by the support member.

2. The image forming apparatus according to claim 1, wherein the main assembly of the apparatus includes a lever member operated by an operator, and the support member is moved between the first position and the second position by operating the lever member.

3. The image forming apparatus according to claim 1, wherein, when the support member is in the first position, the support member is engaged with an engagement hole in the second gear so that the shaft that holds the second gear is supported by the support member.

4. The image forming apparatus according to claim 1, wherein, when the support member is in the first position, an engagement hole formed in the support member is engaged with the shaft that holds the second gear so that the shaft holding the second gear is supported by the support member.

5. The image forming apparatus according to claim 1, wherein the roller is a roller capable of rotating in a first direction and in a direction opposite to the first direction.

6. An image forming apparatus that forms an image on a recording medium, the image forming apparatus comprising:

a main assembly of the apparatus including a drive source and a first gear rotated by power of the drive source; and a fixation unit configured to fix the image formed on the recording medium to the recording medium, the fixation unit capable of being attached to and detached from the main assembly of the apparatus and including a roller and a second gear that meshes with the first gear to transmit the power of the drive source to the roller, wherein the fixation unit includes a support member, and with the fixation unit attached to the main assembly of the apparatus, the support member is movable between a first position where a shaft that holds the second gear is supported by the main assembly of the apparatus and a second position where the shaft is not supported by the main assembly of the apparatus.

7. The image forming apparatus according to claim 6, wherein the fixation unit includes a lever member operated by an operator, and the support member is moved between the first position and the second position by operating the lever member.

8. The image forming apparatus according to claim 6, wherein, when the support member is in the first position, the support member is engaged with an engagement hole formed in the main assembly of the apparatus so that the shaft that holds the second gear is supported by the main assembly of the apparatus.

9. The image forming apparatus according to claim 6, wherein the roller is a roller capable of rotating in a first direction and in a direction opposite to the first direction.

* * * * *